US012552506B2

(12) United States Patent
Hamada et al.

(10) Patent No.: US 12,552,506 B2
(45) Date of Patent: Feb. 17, 2026

(54) MARINE VESSEL AND CONTROL APPARATUS FOR MARINE VESSEL

(71) Applicant: YAMAHA HATSUDOKI KABUSHIKI KAISHA, Iwata (JP)

(72) Inventors: Satoru Hamada, Shizuoka (JP); Akihiro Onoue, Shizuoka (JP); Toshio Suzuki, Shizuoka (JP); Masaru Suemori, Shizuoka (JP); Yoshiyuki Kadobayashi, Shizuoka (JP); Manami Oyama, Shizuoka (JP); Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 416 days.

(21) Appl. No.: 18/197,182

(22) Filed: May 15, 2023

(65) Prior Publication Data

US 2023/0373607 A1 Nov. 23, 2023

(30) Foreign Application Priority Data

May 17, 2022 (JP) ..... 2022-080999

(51) Int. Cl.

| | |
|---|---|
| ***B63H 20/10*** | (2006.01) |
| ***B63B 79/40*** | (2020.01) |
| ***B63H 20/00*** | (2006.01) |
| ***B63H 20/12*** | (2006.01) |

(52) U.S. Cl.

CPC ..... *B63H 20/106* (2013.01); *B63B 79/40* (2020.01); *B63H 20/12* (2013.01); *B63H 2020/003* (2013.01)

(58) Field of Classification Search

CPC ..... B63H 20/106; B63H 20/12; B63H 2020/003; B63B 79/40

See application file for complete search history.

(56) References Cited

U.S. PATENT DOCUMENTS 5,352,137 A * 10/1994 Iwai ..... B63H 20/106 440/1
5,647,780 A * 7/1997 Hosoi ..... B63H 20/10 440/61 G

FOREIGN PATENT DOCUMENTS

JP 2007091115 A * 4/2007 ..... B63H 25/02
JP 2020-073389 A 5/2020

* cited by examiner

*Primary Examiner* — Stephen P Avila
(74) *Attorney, Agent, or Firm* — Keating & Bennett, LLP

(57) ABSTRACT

A marine vessel includes a hull, left and right propulsion devices attached to a stern of the hull, left and right drive units to change a rotation angle of the left and right propulsion devices about left and right tilt shafts, and to set an angle at which a position of a lower portion of the left and right propulsion devices becomes highest as a maximum rotation angle, left and right lift mechanisms to change a vertical position of the left and right propulsion devices with respect to the hull, and a controller configured or programmed to function as a judging unit to judge whether or not a displacement in a roll direction of the hull has occurred, and a control unit to control the left and right drive units and the left and right lift mechanisms.

12 Claims, 9 Drawing Sheets

*FIG. 8*

| | RIGHT ROLL | | LEFT ROLL | |
|---|---|---|---|---|
| | LEFT | RIGHT | LEFT | RIGHT |
| FIRST CONTROL (TRIM) | ↑ | ↓ | ↓ | ↑ |
| SECOND CONTROL (LIFT) | ↓ | ↑ | ↑ | ↓ |
| THIRD CONTROL (OUTPUT) | ↓ | ↑ | ↑ | ↓ |

MARINE VESSEL AND CONTROL APPARATUS FOR MARINE VESSEL

CROSS REFERENCE TO RELATED APPLICATIONS

This application claims the benefit of priority to Japanese Patent Application No. 2022-080999, filed on May 17, 2022. The entire contents of this application are hereby incorporated herein by reference.

BACKGROUND OF THE INVENTION

1. Field of the Invention

The present invention relates to a marine vessel, and a control apparatus for the marine vessel.

2. Description of the Related Art

A hull of a marine vessel may be displaced in a roll direction during navigation of the marine vessel such as during high-speed navigation of the marine vessel. A chine walk may also include a roll component. It is not easy for a general marine vessel operator to suppress the displacement in the roll direction by performing a counter steering operation. In recent years, along with an increase in the size of the marine vessel and an increase in the speed of the marine vessel, there are an increasing number of cases in which the displacement in the roll direction occurs even in a marine vessel equipped with a plurality of propulsion devices.

Japanese Laid-Open Patent Publication (kokai) No. 2020-73389 discloses a technique that increases or decreases engine outputs of left and right outboard motors when the displacement in the roll direction occurs.

However, Japanese Laid-Open Patent Publication (kokai) No. 2020-73389 does not describe suppression of the displacement in the roll direction by techniques other than the control of the engine outputs. There is room for improvement in terms of suppressing the displacement in the roll direction.

SUMMARY OF THE INVENTION

Preferred embodiments of the present invention provide marine vessels and control apparatuses for the marine vessels that are each able to suppress a displacement in a roll direction of a hull.

According to a preferred embodiment of the present invention, a marine vessel includes a hull, left and right propulsion devices attached to a stern of the hull and located left of and right of, respectively, a center of the hull in a left-right direction, left and right drive units to change a rotation angle of the left and right propulsion devices about left and right tilt shafts, respectively, and to set an angle at which a position of a lower portion of the left and right propulsion devices becomes highest, as a maximum rotation angle, left and right lift mechanisms to change a vertical position of the left and right propulsion devices, respectively, with respect to the hull, and a controller configured or programmed to function as a judging unit to judge whether or not a displacement in a roll direction of the hull has occurred, and a control unit to control the left and right drive units and the left and right lift mechanisms. In a case that the judging unit judges that the displacement in the roll direction of the hull has occurred, the control unit executes either one or both of a first control to change the rotation angle of at least one of the left propulsion device with the left drive unit or the right propulsion device with the right drive unit, and a second control to change the vertical position of at least one of the left propulsion device with the left lift mechanism or the right propulsion device with the right lift mechanism.

According to another preferred embodiment of the present invention, a control apparatus for a marine vessel that includes left and right propulsion devices attached to a stern of a hull and located left of and right of, respectively, a center of the hull in a left-right direction, left and right drive units to change a rotation angle of the left and right propulsion devices about left and right tilt shafts, respectively, and to set an angle at which a position of a lower portion of the left and right propulsion devices becomes highest, as a maximum rotation angle, and left and right lift mechanisms to change a vertical position of the left and right propulsion devices, the control apparatus including a controller configured or programmed to function as a judging unit to judge whether or not a displacement in a roll direction of the hull has occurred, and a control unit to control the left and right drive units and the left and right lift mechanisms. In a case that the judging unit judges that the displacement in the roll direction of the hull has occurred, the control unit executes either one or both of a first control to change the rotation angle of at least one of the left propulsion device with the left drive unit or the right propulsion device with the right drive units, and a second control to change the vertical position of at least one of the left propulsion device with the left lift mechanism or the right propulsion device with the right lift mechanism.

According to the preferred embodiments of the present invention described above, whether or not the displacement in the roll direction of the hull has occurred is judged by the judging unit, and the left and right drive units and the left and right lift mechanisms are controlled by the control unit. In the case of being judged that the displacement in the roll direction of the hull has occurred, either one or both of the first control to change the rotation angle of at least one of the left propulsion device with the left drive unit or the right propulsion device with the right drive unit, and the second control to change the vertical position of at least one of the left propulsion device with the left lift mechanism or the right propulsion device with the right lift mechanism, are executed. As a result, it is possible to suppress the displacement in the roll direction of the hull.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 8 is a conceptual diagram that shows a roll suppression control.

DETAILED DESCRIPTION OF THE PREFERRED EMBODIMENTS

Hereinafter, preferred embodiments of the present invention will be described with reference to the drawings.

Figure 1:
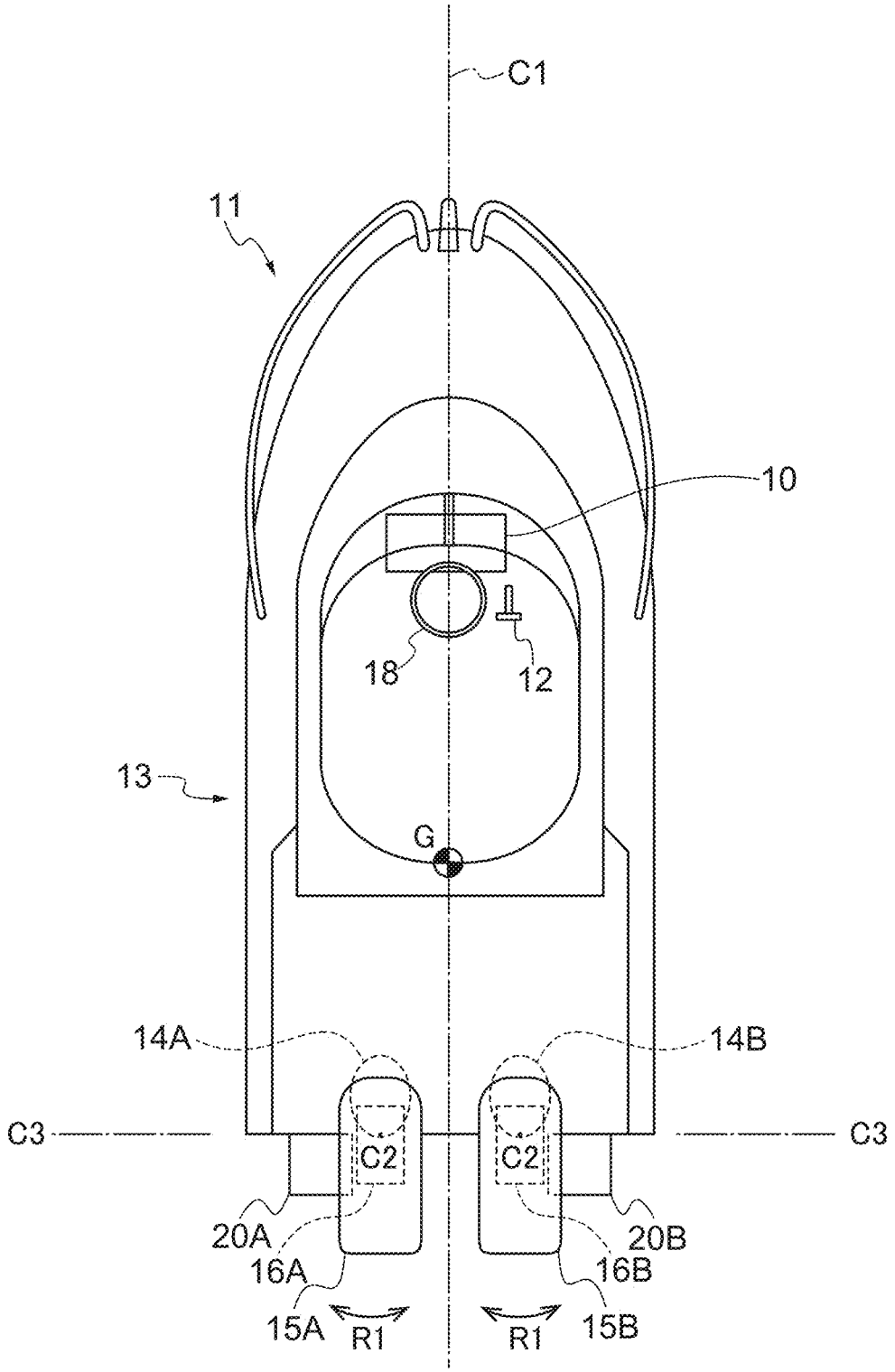
FIG. 1 is a top view of a marine vessel to which a control apparatus according to a preferred embodiment of the present invention is applied.

FIG. 1 is a top view of a marine vessel 11 to which a control apparatus according to a preferred embodiment of the present invention is applied. The marine vessel 11 includes a hull 13, a plurality of (for example, a pair of) outboard motors 15 that function as marine vessel propulsion devices mounted on the hull 13, and a plurality of (for example, a pair of) trim tabs 20. A central unit 10, a steering wheel 18, and a throttle lever 12 are provided near a maneuvering seat of the hull 13.

In the following description, front, rear, left, right, up, and down directions mean front, rear, left, right, up, and down directions of the hull 13, a front-rear direction means a front-rear direction of the hull 13, a left-right direction means a left-right direction of the hull 13, and an up-down direction means an up-down direction of the hull 13. For example, as shown in FIG. 1, a center line C1 extending in the front-rear direction of the hull 13 passes through the center of gravity G of the marine vessel 11. The front-rear direction is a direction along the center line C1 of FIG. 1. The front direction is an upward direction along the center line C1 of FIG. 1. The rear direction is a downward direction along the center line C1 of FIG. 1. The left direction, the right direction, and the left-right direction are based on the case where the hull 13 is viewed from the rear. A vertical direction (the up-down direction) is a direction perpendicular to the front-rear direction and the left-right direction.

The two outboard motors 15 (the pair of outboard motors 15) are mounted side by side on the stern of the hull 13. When distinguishing between the two outboard motors 15, the one outboard motor 15 located on the port side is referred to as "an outboard motor 15A" and the one outboard motor 15 located on the starboard side is referred to as "an outboard motor 15B". The outboard motor 15A is located on the left of a center in the left-right direction, and the outboard motor 15B is located on the right of the center in the left-right direction. The outboard motor 15A and the outboard motor 15B define a set of propulsion devices. The outboard motor 15A and the outboard motor 15B are attached to the hull 13 via attachment units 14 (an attachment unit 14A and an attachment unit 14B), respectively. The outboard motor 15A and the outboard motor 15B include engines 16 (an engine 16A and an engine 16B) that are internal combustion engines, respectively.

Each of the outboard motors 15 obtains a propulsion force from a propeller 123 (see FIG. 2) rotated by a driving force of the corresponding engine 16. When distinguishing between the attachment units 14, the one attachment unit 14 corresponding to the outboard motor 15A is referred to as "the attachment unit 14A" and the one attachment unit 14 corresponding to the outboard motor 15B is referred to as "the attachment unit 14B". In addition, when distinguishing between the engines 16, the one engine 16 corresponding to the outboard motor 15A is referred to as "the engine 16A" and the one engine 16 corresponding to the outboard motor 15B is referred to as "the engine 16B".

The pair of trim tabs 20 (the two trim tabs 20) are attached to the port side of the stern and the starboard side of the stern so as to be able to swing about a swing axis C3. When distinguishing between the two trim tabs 20, the one trim tab 20 located on the port side is referred to as "a trim tab 20A" and the one trim tab 20 located on the starboard side is referred to as "a trim tab 20B".

Figure 2:
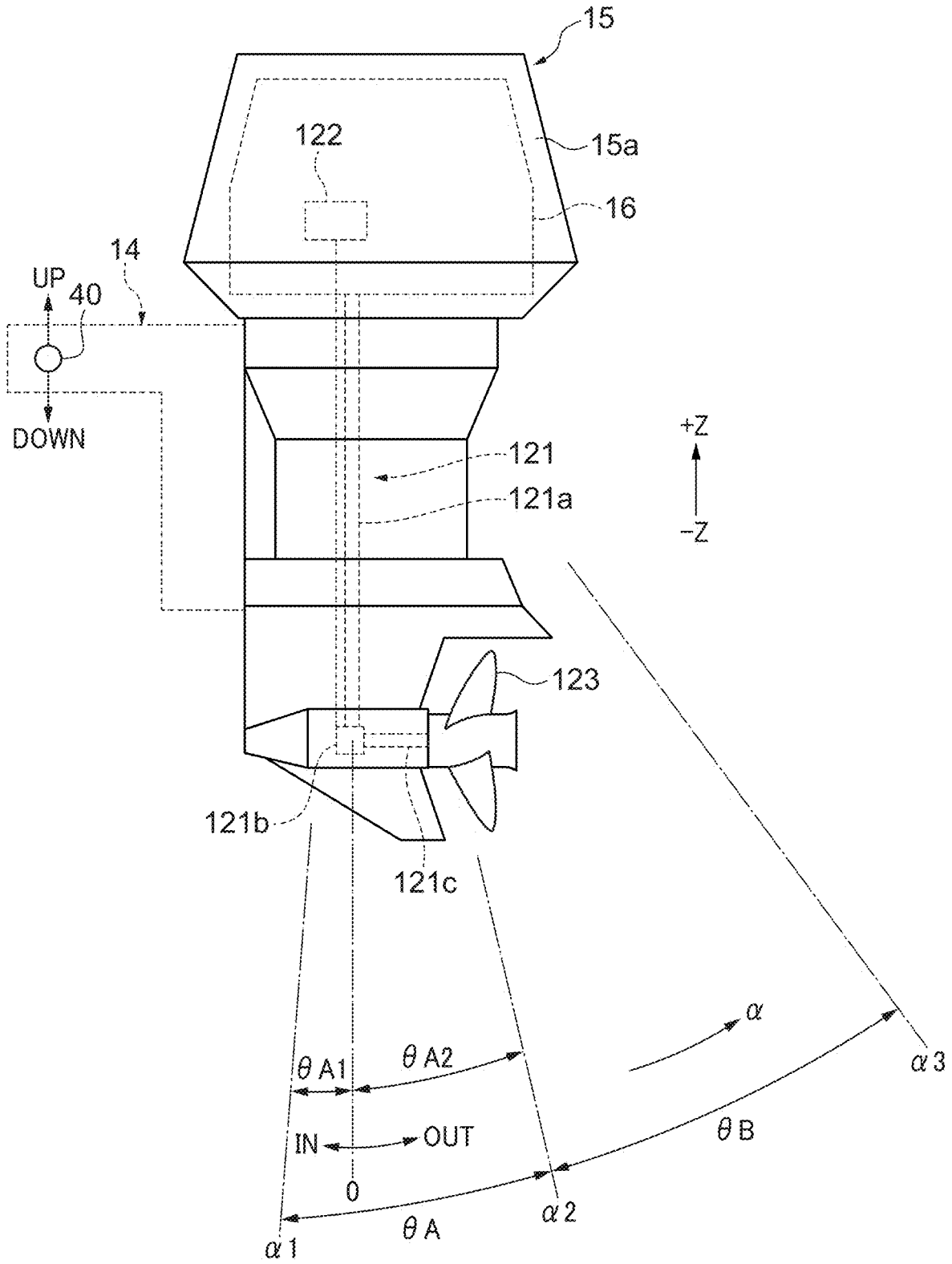
FIG. 2 is a schematic side view of an outboard motor.

FIG. 2 is a schematic side view of the outboard motor 15. Since the configuration of the outboard motor 15A and the configuration of the outboard motor 15B are common to each other, the one outboard motor 15 will be described.

As shown in FIG. 2, the outboard motor 15 includes an outboard motor main body 15*a*, the attachment unit 14 to attach the outboard motor main body 15*a* to the hull 13, and a steering shaft (not shown). The steering shaft is provided on the outboard motor main body 15*a* and is supported by the attachment unit 14. The outboard motor main body 15*a* is configured to be able to be steered to the left or the right about the steering shaft. The outboard motor main body 15*a* is attached to the rear portion of the hull 13 (a transom 13*a* (see FIG. 3)) via the steering shaft and the attachment unit 14. By operating the steering wheel 18, the outboard motor main body 15*a* rotates to the left or the right (in a direction of a left arrow or in a direction of a right arrow indicated by R1 in FIG. 1) about a rotation center C2 (see FIG. 1). As a result, the marine vessel 11 is steered.

In addition, the outboard motor main body 15*a* is freely rotatable about a horizontal tilt shaft 40 via the attachment unit 14. The attachment unit 14A and the attachment unit 14B include power trim and tilt mechanisms (PTT mechanisms) 23 (a PTT mechanism 23A and a PTT mechanism 23B) (see FIGS. 3, 4, and 7). Each of the PTT mechanisms 23 rotates the corresponding outboard motor 15 (strictly speaking, the outboard motor main body 15*a* of the corresponding outboard motor 15) around the tilt shaft 40. As a result, since it is possible to change an inclination angle of the outboard motor 15 with respect to the hull 13, it is possible to perform a trim adjustment, and it is possible to tilt up/tilt down the outboard motor 15. In addition, the attachment unit 14A and the attachment unit 14B are individually configured to be able to vary the position of the tilt shaft 40 in the up-down direction. As a result, it is possible to make a vertical position of the corresponding outboard motor 15 with respect to the hull 13 variable. Details of these will be described below with reference to FIGS. 3 to 5.

As shown in FIG. 2, the outboard motor main body 15*a* includes the engine 16, a power transmission mechanism 121, a shift actuator 122, and the propeller 123 (a screw propeller). The power transmission mechanism 121 transmits the driving force of the engine 16 to the propeller 123. In addition, the power transmission mechanism 121 includes a drive shaft 121*a*, a gear portion 121*b*, and a propeller shaft 121*c*. The drive shaft 121*a* is connected to a crankshaft (not shown) of the engine 16 so as to be able to transmit the power of the engine 16. The drive shaft 121*a* extends in the up-down direction (a Z direction). An upward direction of the Z direction is a +Z direction, and a downward direction of the Z direction is a −Z direction.

The propeller 123 is connected to the propeller shaft 121*c* and rotates around a rotation shaft line extending in the front-rear direction. The propeller 123 rotates underwater to generate a thrust in an axial direction, thus propelling the hull 13 forward or backward. The gear portion 121*b* is located at a lower portion of the outboard motor 15 and is also located at a lower end portion of the drive shaft 121*a*. The gear portion 121*b* transmits the rotation of the drive shaft 121*a* to the propeller shaft 121*c*.

The shift actuator 122 switches the shift state of the outboard motor 15 based on a user's operation. Specifically, the shift actuator 122 switches the shift position between a forward position, a reverse position, and a neutral position by switching the engagement of the gear portion 121*b* based on the user's operation.

As shown in FIG. 2, the PTT mechanism 23, which functions as a drive unit, sets an angle, at which a position of a lower portion of the outboard motor main body 15*a* (the lower portion of the outboard motor 15) becomes highest, as a maximum rotation angle α3, and changes a rotation angle α of the outboard motor main body 15*a* (the outboard motor 15) about the tilt shaft 40. A direction in which the rotation angle α of the outboard motor main body 15*a* increases is a counterclockwise direction in FIG. 2, and a direction in which the rotation angle α of the outboard motor main body 15*a* decreases is a clockwise direction in FIG. 2.

The rotation angle α of the outboard motor main body 15*a* when a shaft line of the drive shaft 121*a* is changed in the up-down direction is assumed to be 0 (zero). A range in which the rotation angle α is between α1 and α2 is a trim range θA, and a range in which the rotation angle α is between α2 and α3 is a tilt range θB.

Increasing the rotation angle α within the trim range θA is referred to as "trim-up", and decreasing the rotation angle α within the trim range θA is referred to as "trim-down". A range (θA1) particularly smaller than 0 in the trim range θA is referred to as "trim-in (IN)", and a range (θA2) particularly larger than 0 in the trim range θA is referred to as "trim-out (OUT)".

Increasing the rotation angle α for the purpose of raising the propeller 123 above the surface of water is referred to as "tilt-up", and decreasing the rotation angle α for the purpose of lowering the propeller 123 above the surface of water is referred to as "tilt-down". Therefore, tilt-up and tilt-down may be used for the vertical movement (the up-down movement) of the outboard motor main body 15*a* in both the trim range θA and the tilt range θB, and may include "trim-up"/"trim-down".

Figure 3:
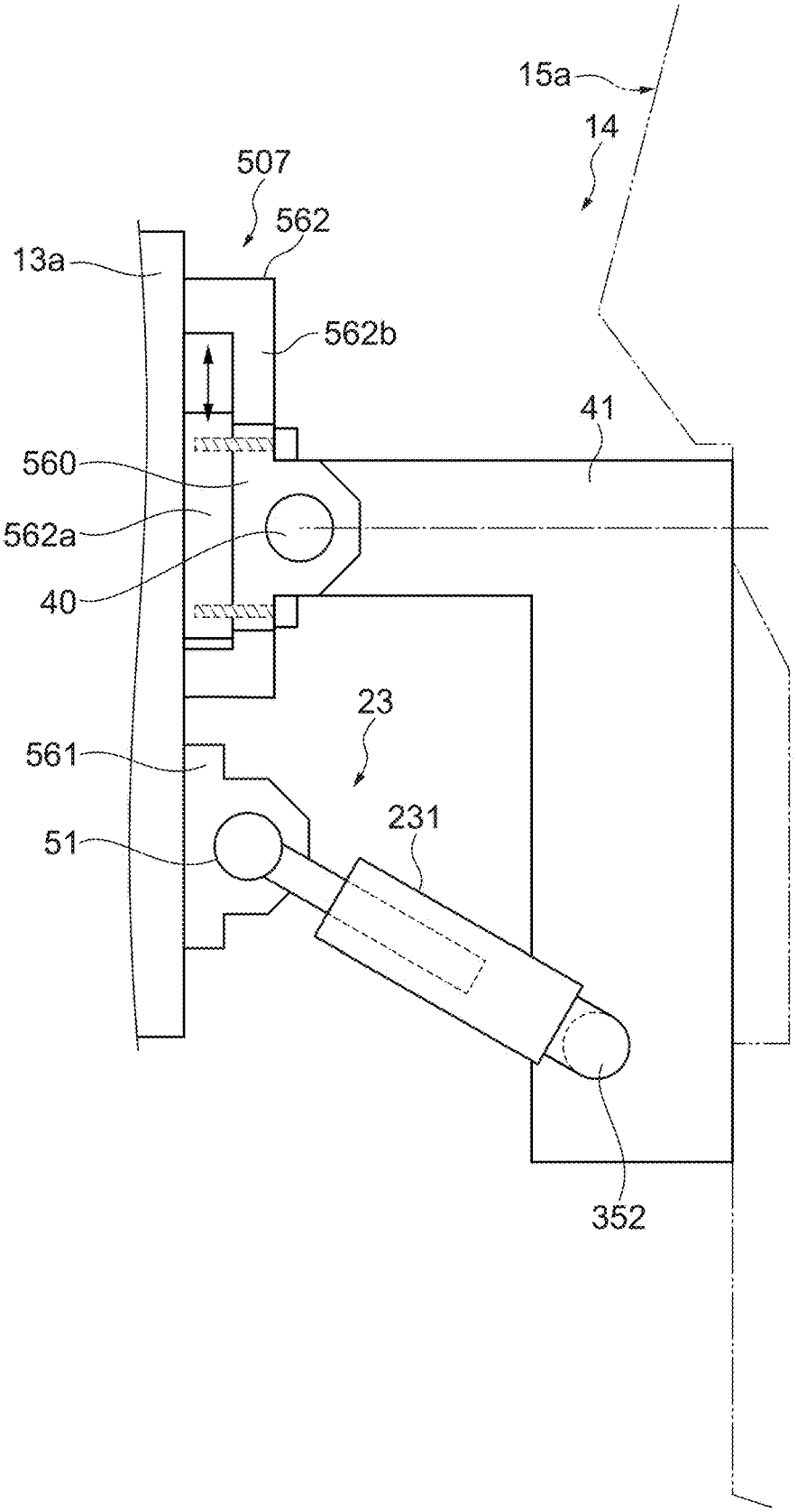
FIG. 3 is a schematic side view of an attachment unit.
Figure 4:
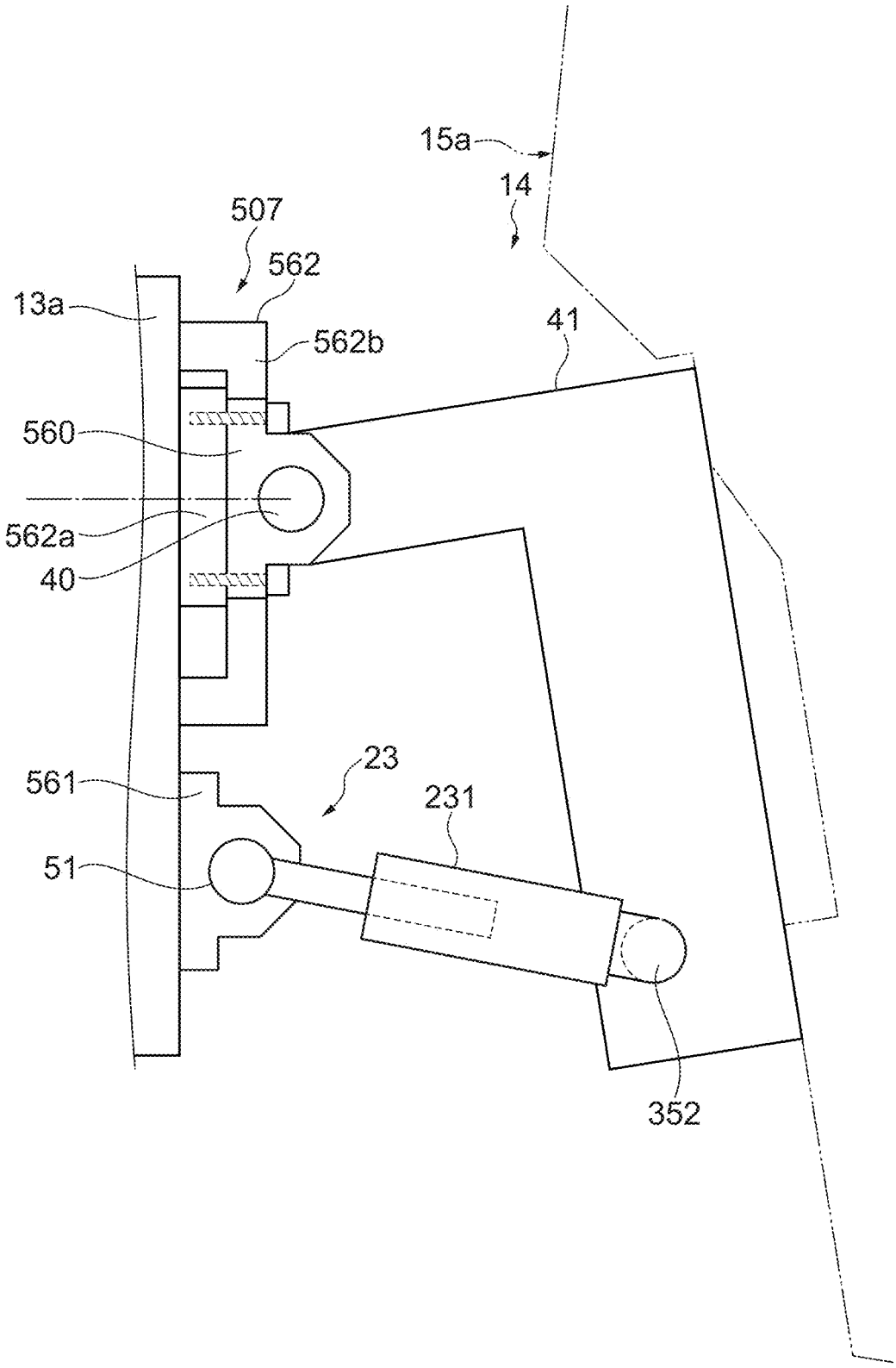
FIG. 4 is a schematic side view of the attachment unit.

FIGS. 3 and 4 are schematic side views of the attachment unit 14. Since the configuration of the attachment unit 14A and the configuration of the attachment unit 14B are common, the one attachment unit 14 will be described. A vertical position of the tilt shaft 40 in FIG. 3 is different from the vertical position of the tilt shaft 40 in FIG. 4.

As shown in FIGS. 3 and 4, the attachment unit 14 includes the PTT mechanism 23, a lift mechanism 507, a second member 561, and a rotating member 41. The lift mechanism 507 includes a first member 560 and a guide rail 562. The first member 560, the second member 561, and the guide rail 562 are attached to the outer surface of the transom 13*a*. The rotating member 41 is an L-shaped member that rotates around the tilt shaft 40. The rotating member 41 supports the outboard motor main body 15*a* via the steering shaft (not shown).

The PTT mechanism 23 includes a trim cylinder 231. A first trim cylinder shaft 51 is a rotary shaft located at a front end portion of the trim cylinder 231. A second trim cylinder shaft 352 is a rotary shaft located at a rear end portion of the rotating member 41. The first member 560 rotatably supports the tilt shaft 40. The second member 561 rotatably supports the first trim cylinder shaft 51. The guide rail 562 holds the first member 560 so as to make the first member 560 movable in the up-down direction.

Figure 5:
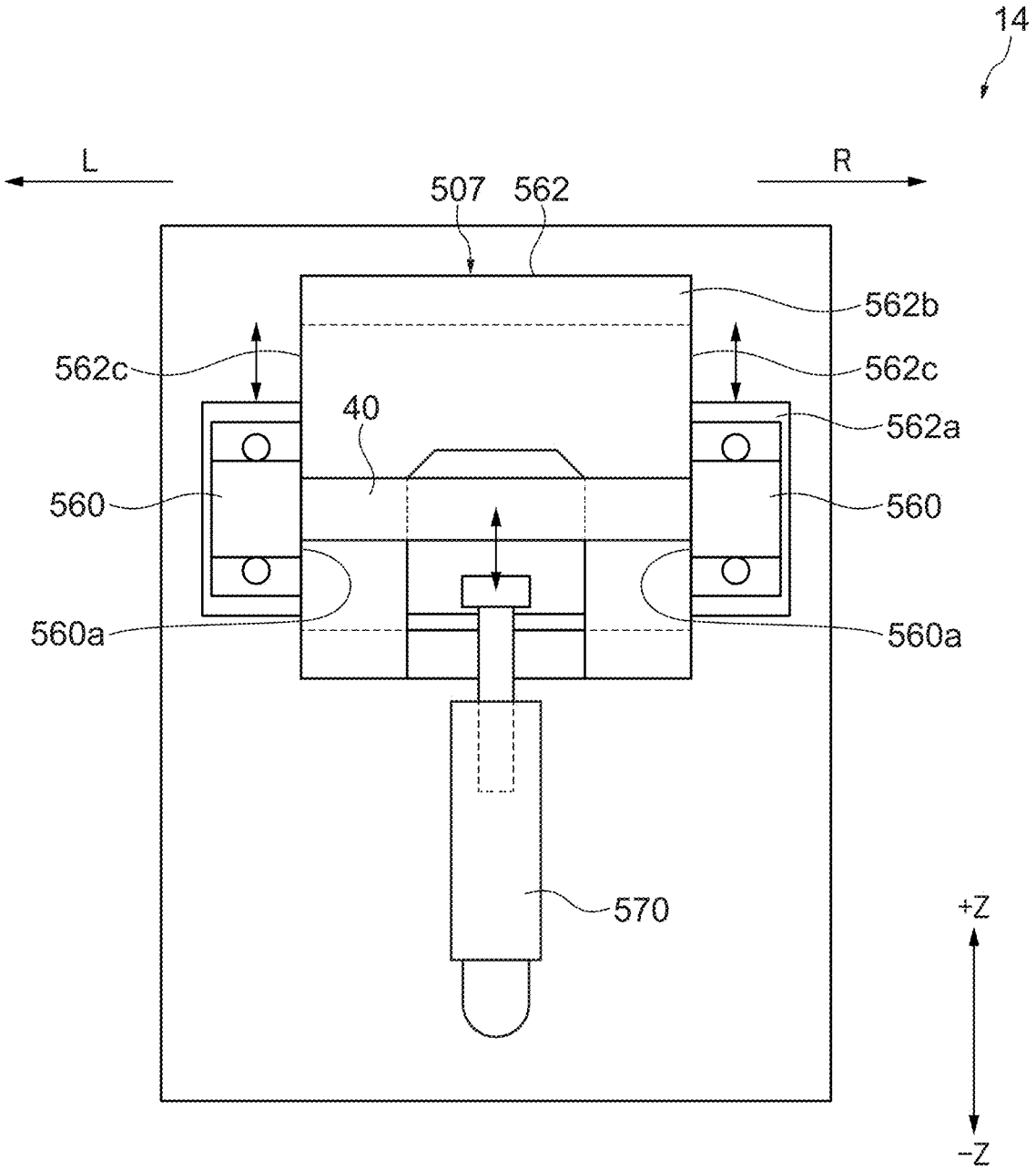
FIG. 5 is a rear view of a lift mechanism.

FIG. 5 is a rear view of the lift mechanism 507. As the lift mechanism 507, a portion or all of the configuration disclosed in Japanese Laid-Open Patent Publication (kokai) No. 2020-66356 may be used.

The lift mechanism 507 further includes a lift cylinder 570. It should be noted that in FIGS. 3 and 4, for convenience of explanation, the illustration of the lift cylinder 570 is omitted. As shown in FIG. 5, the guide rail 562 is configured to guide the movement of the first member 560 in the up-down direction. The guide rail 562 includes a plate member 562*a* and a bracket portion 562*b*. It should be noted that in FIG. 5, for convenience of explanation, the illustration of the trim cylinder 231 and the illustration of the rotating member 41 are omitted. In addition, in FIG. 5, for convenience of explanation, the lift cylinder 570 is shown larger than it actually is.

The plate member 562*a* extends in the left-right direction, and the first member 560 is attached to both ends of the plate member 562*a* from the rear. The bracket portion 562*b* holds the plate member 562*a* from the rear. An upper end and a lower end of the plate member 562*a* regulate a movement range of the plate member 562*a* in the up-down direction. The bracket portion 562*b* has a C shape that covers the plate member 562*a* from the rear (see FIG. 3). The plate member 562*a* protrudes from both ends of the bracket portion 562*b* in the left-right direction.

Inner surfaces 560*a* of the first member 560 abut on both end surfaces 562*c* of the bracket portion 562*b* in the left-right direction. As a result, the first member 560 and the plate member 562*a* move in the up-down direction while being guided by the bracket portion 562*b*.

The lift mechanism 507 changes the position of the tilt shaft 40 in the up-down direction with respect to the transom 13*a* by changing the position of the first member 560 in the up-down direction. The lift cylinder 570 extends in the up-down direction at a position lower than the tilt shaft 40, and an upper end of the lift cylinder 570 is fixed to the plate member 562*a*. Therefore, the plate member 562*a*, the first member 560, and the tilt shaft 40 move upward as the lift cylinder 570 extends (for example, the state shown in FIG. 3 changes to the state shown in FIG. 4). As a result, a distance between the tilt shaft 40 and the first trim cylinder shaft 51 becomes longer.

On the other hand, the plate member 562*a*, the first member 560, and the tilt shaft 40 move downward as the lift cylinder 570 contracts. As a result, the distance between the tilt shaft 40 and the first trim cylinder shaft 51 becomes shorter.

Since the tilt shaft 40 is moved in the up-down direction by the lift mechanism 507 in this way, it is possible to change a vertical position of the outboard motor main body 15*a* with respect to the hull 13. Moving the tilt shaft 40 upward is referred to as "lift-up", and moving the tilt shaft 40 downward is referred to as "lift-down". In addition, since the vertical position of the tilt shaft 40 is variable, it is also possible to change an operating range of trim/tilt of the outboard motor main body 15*a* (an upper limit and a lower limit of the rotation angle of the outboard motor main body 15*a* by the trim cylinder 231).

It should be noted that the mechanism to change the vertical position of the outboard motor main body 15*a* is not limited to this example, and another mechanism disclosed in Japanese Laid-Open Patent Publication (kokai) No. 2020-66356 or any one of other publicly known mechanisms may be used.

Figure 6:
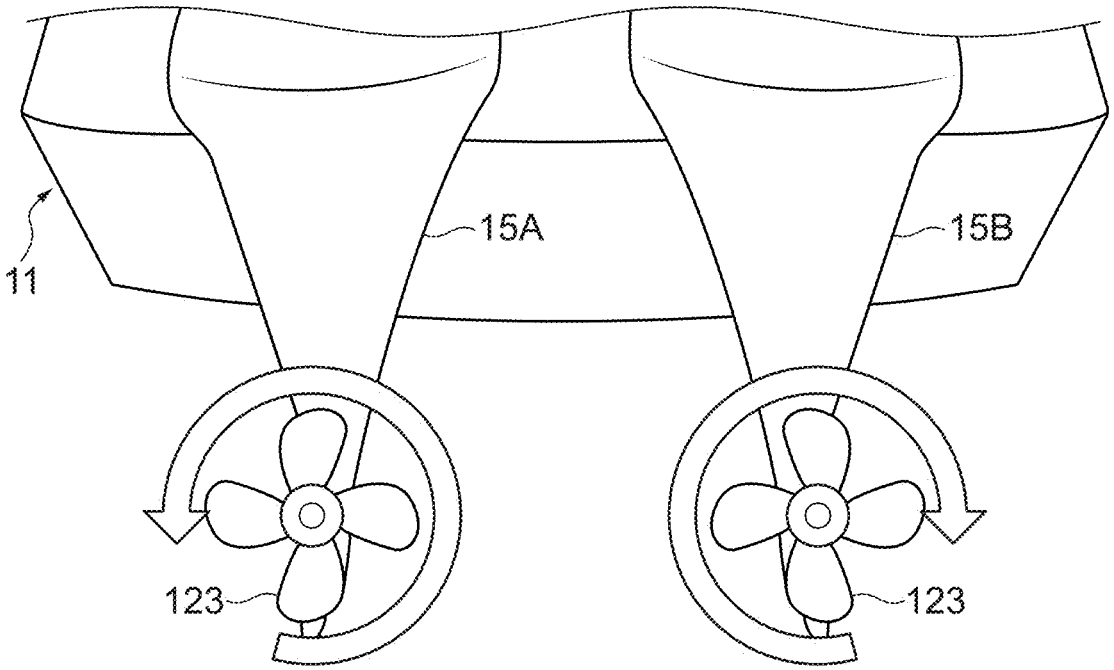
FIG. 6 is a rear view of the marine vessel to which the control apparatus according to a preferred embodiment of the present invention is applied.

FIG. 6 is a rear view of the marine vessel 11. As shown in FIG. 6, when the marine vessel 11 moves forward, the propeller 123 of the outboard motor 15A rotates counterclockwise when viewed from the rear, and the propeller 123 of the outboard motor 15B rotates clockwise when viewed from the rear.

Figure 7:
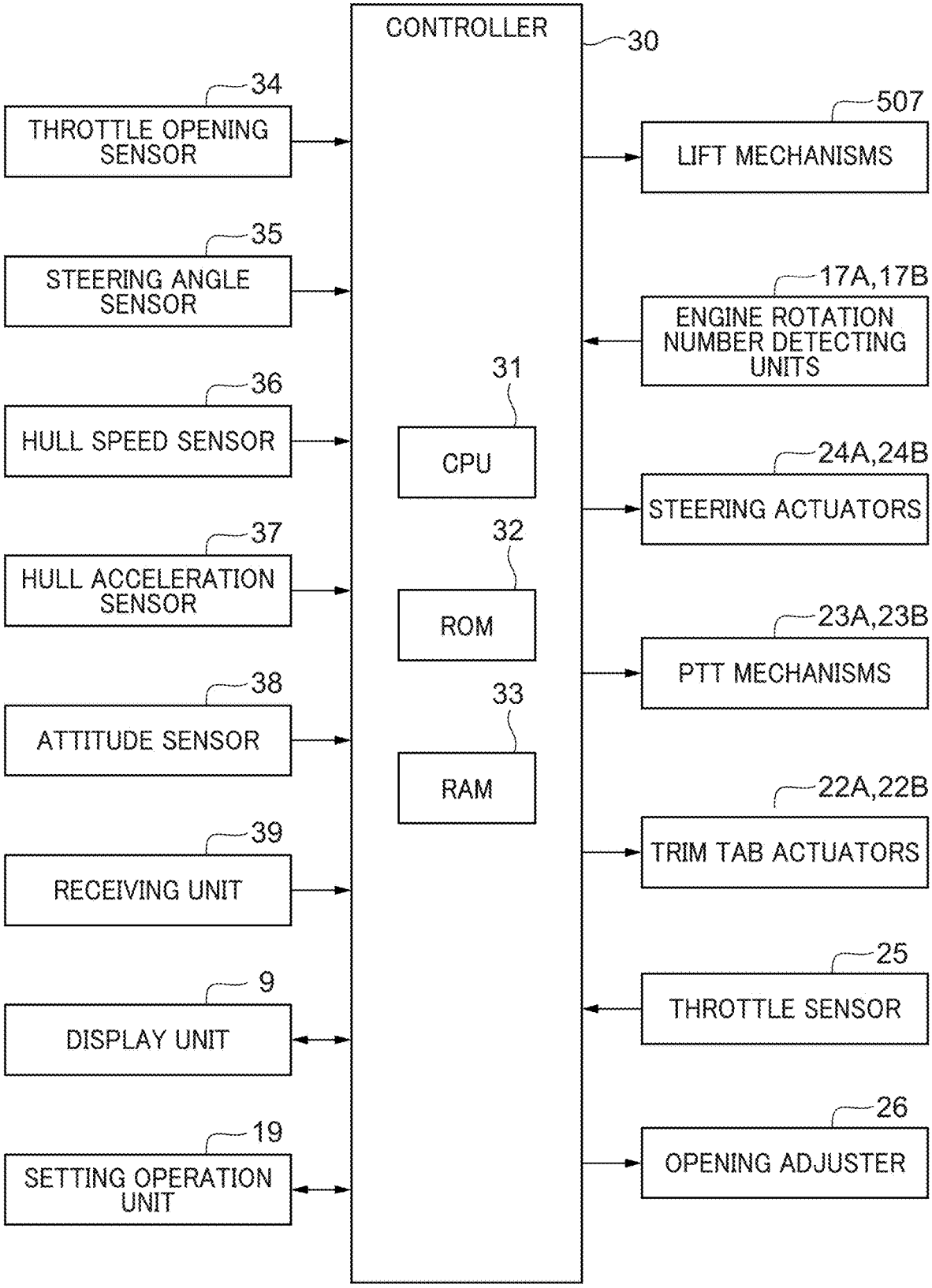
FIG. 7 is a block diagram of a marine vessel maneuvering system in the marine vessel to which the control apparatus according to a preferred embodiment of the present invention is applied.

FIG. 7 is a block diagram of a marine vessel maneuvering system in the marine vessel 11. The marine vessel maneuvering system includes the control apparatus for the marine vessel according to a preferred embodiment of the present invention. The marine vessel 11 includes a controller 30 as an element of the control apparatus, the lift mechanisms 507 described above, throttle opening sensors 34, a steering angle sensor 35, a hull speed sensor 36, a hull acceleration sensor 37, an attitude sensor 38, a receiving unit 39, a display unit 9, and a setting operation unit 19. In addition, the marine vessel 11 includes engine rotation number detecting units 17 (an engine rotation number detecting unit 17A and an engine rotation number detecting unit 17B), steering actuators 24 (a steering actuator 24A and a steering actuator 24B), the PTT mechanisms 23 (the PTT mechanism 23A and the PTT mechanism 23B), and trim tab actuators 22 (a trim tab actuator 22A and a trim tab actuator 22B). In addition, the marine vessel 11 includes a throttle sensor 25 and an opening adjuster 26.

The controller 30, the throttle sensor 25, the opening adjuster 26, the steering angle sensor 35, the hull speed sensor 36, the hull acceleration sensor 37, the attitude sensor 38, the receiving unit 39, the display unit 9, and the setting operation unit 19 are included in the central unit 10, or are located near the central unit 10. The steering actuator 24A and the steering actuator 24B correspond to the outboard motor 15A and the outboard motor 15B, respectively. In addition, the PTT mechanism 23A and the PTT mechanism 23B correspond to the outboard motor 15A and the outboard motor 15B, respectively. The throttle opening sensor 34 and the engine rotation number detecting unit 17 are provided in the corresponding outboard motor 15. The trim tab actuator 22A and the trim tab actuator 22B are included in the trim tab 20A and the trim tab 20B, respectively.

The controller 30 includes a CPU (Central Processing Unit) 31, a ROM (Read Only Memory) 32, a RAM (Random Access Memory) 33, and a timer (not shown). The ROM 32 stores control programs. The CPU 31 implements various kinds of control processes by loading the control programs stored in the ROM 32 into the RAM 33 and executing them. The RAM 33 provides a working area when the CPU 31 executes the control program.

Respective detection results, which are obtained by the throttle sensor 25, the throttle opening sensors 34, the steering angle sensor 35, the hull speed sensor 36, the hull acceleration sensor 37, the attitude sensor 38, and the engine rotation number detecting units 17 are supplied to the controller 30. The throttle sensor 25 detects the operating position of the throttle lever 12. The throttle opening sensor 34 detects an opening of a throttle valve (not shown). The opening adjuster 26 adjusts the opening of the throttle valve. The steering angle sensor 35 detects a rotating angle when the steering wheel 18 is rotated. The hull speed sensor 36 detects a navigating speed (a marine vessel speed) of the marine vessel 11 (the hull 13). The hull acceleration sensor 37 detects an acceleration of the marine vessel 11 (the hull 13).

The attitude sensor 38 includes, for example, a gyro sensor, a magnetic azimuth sensor, etc. Based on signals outputted from the attitude sensor 38, the controller 30 calculates a roll angle, a pitch angle, and a yaw angle. It should be noted that the controller 30 may calculate the roll angle and the pitch angle of the hull 13 based on an output signal of the hull acceleration sensor 37. The receiving unit 39 includes a GNSS (Global Navigation Satellite Systems) receiver such as a GPS (Global Positioning System) receiver, and has a function of receiving GPS signals and various kinds of signals as position information. The signals received by the receiving unit 39 are supplied to the CPU 31. It should be noted that the acceleration of the hull 13 may be obtained from the GPS signals received by the receiving unit 39.

The engine rotation number detecting unit 17 detects a rotation number per unit time of the corresponding engine 16. The display unit 9 displays various kinds of information. The setting operation unit 19 includes an operation element (not shown) to perform operations related to marine vessel maneuvering, a PTT operation switch (not shown), a setting operation element (not shown) to perform various kinds of settings, and an inputting operation element (not shown) to input various kinds of instructions.

The steering actuator 24 rotates the corresponding outboard motor 15 with respect to the hull 13 about the rotation center C2. By respective rotation of the outboard motor 15A and the outboard motor 15B around the rotation center C2, it is possible to change a direction in which the propulsion force acts with respect to the center line C1 of the hull 13.

The PTT mechanism 23 rotates the corresponding outboard motor 15 around the tilt shaft 40. The PTT mechanism 23 works, for example, by operating the PTT operation switch. As a result, it is possible to change the rotation angle (the inclination angle) of the outboard motor 15 (the outboard motor main body 15*a*) with respect to the hull 13. The PTT mechanism 23 is controlled also by the controller 30. For example, the controller 30 is able to individually control the PTT mechanism 23A and the PTT mechanism 23B to change the rotation angle of the corresponding outboard motor 15.

The trim tab actuator 22A and the trim tab actuator 22B are controlled by the controller 30. For example, the controller 30 makes each of the trim tab actuators 22 work (i.e., actuates each of the trim tab actuators 22) by outputting a control signal to each of the trim tab actuators 22. The actuation of each of the trim tab actuators 22 causes the corresponding trim tab 20 to swing.

In addition, the controller 30 individually controls the lift mechanisms 507 (the lift mechanism 507 included in the attachment unit 14A and the lift mechanism 507 included in the attachment unit 14B). For example, the controller 30 causes each of the lift mechanisms 507 to perform the lift-up or the lift-down by outputting a control signal to the lift cylinder 570 of each of the lift mechanisms 507.

The signals outputted from the attitude sensor 38 include a yaw rate around a yaw axis (a yaw rotation angular velocity). Based on the yaw rate outputted from the attitude sensor 38, the controller 30 judges whether or not a traveling direction of the hull 13 is a straight traveling direction. In addition, the signals outputted from the attitude sensor 38 include a roll rate around a roll axis and a pitch rate around a pitch axis. Based on the signals outputted from the attitude sensor 38, the controller 30 is able to judge the presence or absence of a displacement in a roll direction of the hull 13, a displacement in a yaw direction of the hull 13 and a displacement in a pitch direction of the hull 13, and the angle. In addition, the controller 30 is able to judge the presence or absence of the occurrence of a chine walk, and the level of the chine walk.

It should be noted that the controller 30 may obtain the detection results obtained by the engine rotation number detecting units 17 via a remote control ECU (Engine Control Unit) (not shown). It should be noted that the controller 30 may control each of the engines 16 via an outboard motor ECU (not shown) provided in each of the outboard motors 15. It should be noted that it is not essential to equip the marine vessel 11 with all of the sensors described above.

FIG. 8 is a conceptual diagram that shows a roll suppression control that is executed to suppress the displacement in the roll direction of the hull 13 when the displacement in the roll direction of the hull 13 occurs. The displacement in the roll direction of the hull 13 is hereinafter referred to as "a roll displacement". It should be noted that a roll component included in the chine walk is also subject to the roll suppression control.

The controller 30, which functions as a judging unit, obtains roll information (signals relating to roll) from the signals outputted from the attitude sensor 38, and judges whether or not the roll displacement of the hull 13 has occurred based on the roll information. It is not always easy to suppress the roll displacement by performing a counter steering operation. Therefore, in the case that the roll displacement of the hull 13 has occurred, the controller 30, which functions as a control unit, executes either one or both of a first control and a second control as the roll suppression control. Alternatively, the controller 30 may execute at least one of the first control, the second control, or a third control.

First, the first control changes the rotation angle (strictly speaking, the rotation angle of the outboard motor main body 15*a* about the tilt shaft 40) of at least one of the outboard motor 15A (a left propulsion device) or the outboard motor 15B (a right propulsion device) by controlling the PTT mechanism 23A and the PTT mechanism 23B functioning as the drive units.

The second control changes the vertical position (strictly speaking, the vertical position of the outboard motor main body 15*a* with respect to the hull 13) of at least one of the outboard motor 15A (the left propulsion device) or the outboard motor 15B (the right propulsion device) by controlling the lift mechanisms 507.

The third control changes the output of at least one of the outboard motor 15A or the outboard motor 15B.

The effects of the first control, the second control, and the third control are as follows. As a view of the hull 13 viewed from the rear, FIG. 8 schematically shows the case that the roll displacement to the right direction (a right roll) occurs and the case that the roll displacement to the left direction (a left roll) occurs. In addition, in the first control, an upward arrow indicates trim-up and a downward arrow indicates trim-down. In the second control, an upward arrow indicates lift-up and a downward arrow indicates lift-down. In the third control, an upward arrow indicates output-up and a downward arrow indicates output-down.

First, in the first control, the controller 30 executes at least one of increasing the rotation angle of the outboard motor 15 corresponding to a direction (a second direction) opposite to a direction of the roll displacement (a first direction) among the left direction and the right direction, or decreasing the rotation angle of the outboard motor 15 corresponding to the direction of the roll displacement (the first direction). Thus, it is possible to suppress the roll displacement by generating a rotational moment opposite to the roll direction.

Here, changing from trim-in to trim-out is also included in "increasing the rotation angle" and "trim-up". In addition, changing from trim-out to trim-in is also included in "decreasing the rotation angle" and "trim-down". The change of the rotation angle also includes a case of changing from trim-in to trim-in with a different angle, and a case of changing from trim-out to trim-out with a different angle.

For example, when the left roll occurs, the controller 30 executes any one of the following (1) to (4) as the first control.

(1) Increasing (trimming up) the rotation angle of the outboard motor 15B (the right propulsion device).

(2) Decreasing (trimming down) the rotation angle of the outboard motor 15A (the left propulsion device).

(3) Increasing (trimming up) the rotation angles of both the outboard motor 15A and the outboard motor 15B but wherein the rotation angle of the outboard motor 15B (the right propulsion device) is increased more than the rotation angle of the outboard motor 15A.

(4) Decreasing (trimming down) the rotation angles of both the outboard motor 15A and the outboard motor 15B but wherein the rotation angle of the outboard motor 15A (the left propulsion device) is decreased less than the rotation angle of the outboard motor 15B.

The reason why the above-described first control is effective will be explained by taking the case in which the left roll occurs as an example. A virtual shaft line, which is parallel to the center line C1 (see FIG. 1) and passes through the center of gravity G of the hull 13 is defined as an X-axis (the roll axis). When the outboard motor 15B (the right propulsion device) is trimmed up, a downward force acting on the starboard rear portion increases (or an upward force decreases). As a result, since a clockwise moment about the X-axis is generated, it is possible to return the posture of the hull 13 to the right direction. It is possible to obtain similar effects in the case that the outboard motor 15A (the left propulsion device) is trimmed down.

In addition, the following effects are also able to be obtained. When the outboard motor 15B (the right propulsion device) is trimmed up, the shortest distance between a vector direction of the thrust of the outboard motor 15B and the center of gravity G of the marine vessel 11 is increased. Therefore, a moment in a pitch-up direction (a direction to make the pitch angle $\alpha$ plus direction) applied to the port bow position about the center of gravity G becomes relatively larger than a moment in the pitch-up direction applied to the starboard bow position. As a result, since the clockwise moment about the X-axis is generated on the hull 13, it is possible to return the posture of the hull 13 to the right direction. It is possible to obtain similar effects in the case that the outboard motor 15A (the left propulsion device) is trimmed down.

Therefore, when assuming that the rotation angle of the outboard motor 15A and the rotation angle of the outboard motor 15B are the same at a point in time when the left roll occurs, the controller 30 controls the rotation angle of the outboard motor 15B to be larger than the rotation angle of the outboard motor 15A.

In the second control, the controller 30 executes at least one of lowering the vertical position of the outboard motor 15 corresponding to the direction opposite to the direction of the roll displacement among the left direction and the right direction, or raising the vertical position of the outboard motor 15 corresponding to the direction of the roll displacement. Thus, it is possible to suppress the roll displacement by generating the rotational moment opposite to the roll direction.

For example, when the left roll occurs, the controller 30 executes any one of the following (1) to (4) as the second control.

(1) Lifting down the outboard motor 15B (the right propulsion device).

(2) Lifting up the outboard motor 15A (the left propulsion device).

(3) Lifting down both the outboard motor 15A and the outboard motor 15B but wherein the outboard motor 15B (the right propulsion device) is moved downward more than the outboard motor 15A.

(4) Lifting up both the outboard motor 15A and the outboard motor 15B but wherein the outboard motor 15A (the left propulsion device) is moved upward less than the outboard motor 15B.

The reason why the above-described second control is effective will be explained by taking the case in which the left roll occurs as an example. When the outboard motor 15B (the right propulsion device) is lifted down, water resistance to the outboard motor 15B (the right propulsion device) increases. As a result, a clockwise moment about a Z-axis (the yaw axis), which passes through the center of gravity G of the hull 13 and is parallel to the up-down direction, is generated. A direction of this moment is the same as a direction of a moment that turns the hull 13 to the right, and this moment acts to roll the hull 13 to the right direction as in the case of turning the hull 13 to the right. As a result, it is possible to return the posture of the hull 13 to the right direction. It is possible to obtain similar effects in the case that the outboard motor 15A (the left propulsion device) is lifted up.

In addition, the following effects are also able to be obtained. When the outboard motor 15B (the right propulsion device) is moved down, the shortest distance between the vector direction of the thrust of the outboard motor 15B and the center of gravity G of the marine vessel 11 is increased. Therefore, the moment in the pitch-up direction applied to the port bow position about the center of gravity G becomes relatively larger than the moment in the pitch-up direction applied to the starboard bow position. As a result, since a clockwise moment about the X-axis is generated on the hull 13, it is possible to return the posture of the hull 13 to the right direction. It is possible to obtain similar effects in the case that the outboard motor 15A (the left propulsion device) is lifted up.

Therefore, when assuming that the vertical position of the outboard motor 15A and the vertical position of the outboard motor 15B are the same at the point in time when the left roll occurs, the controller 30 controls the vertical position of the outboard motor 15B to be lower than the vertical position of the outboard motor 15A.

In the third control, the controller 30 executes at least one of decreasing the output of the outboard motor 15 corresponding to the direction opposite to the direction of the roll displacement among the left direction and the right direction, or increasing the output of the outboard motor 15 corresponding to the direction of the roll displacement. Thus, it is possible to suppress the roll displacement by generating the rotational moment opposite to the roll direction.

For example, when the left roll occurs, the controller 30 executes any one of the following (1) to (4) as the third control.

(1) Decreasing the output of the outboard motor 15B (the right propulsion device).

(2) Increasing the output of the outboard motor 15A (the left propulsion device).

(3) Decreasing the outputs of both the outboard motor 15A and the outboard motor 15B but wherein the output of the outboard motor 15B (the right propulsion device) is decreased more than the output of the outboard motor 15A.

(4) Increasing the outputs of both the outboard motor 15A and the outboard motor 15B but wherein the output of the outboard motor 15A (the left propulsion device) is increased more than the output of the outboard motor 15B.

The reason why the above-described third control is effective will be explained by taking the case in which the left roll occurs as an example. When the output of the outboard motor 15B (the right propulsion device) is decreased, a clockwise moment about the Z-axis is generated. A direction of this moment is the same as the direction of the moment that turns the hull 13 to the right, and this moment acts to roll the hull 13 to the right direction as in the case of turning the hull 13 to the right. As a result, it is possible to return the posture of the hull 13 to the right direction. It is possible to obtain similar effects in the case that the output of the outboard motor 15A (the left propulsion device) is increased.

In addition, when the output of the outboard motor 15B (the right propulsion device) is decreased, the reaction of the propeller 123 of the outboard motor 15B, which is rotating clockwise when viewed from the rear, is reduced. As a result, since it relatively acts to roll the hull 13 to the right direction, it is possible to return the posture of the hull 13 to the right direction. It is possible to obtain similar effects in the case that the output of the outboard motor 15A (the left propulsion device) is increased.

Therefore, when assuming that the output of the outboard motor 15A and the output of the outboard motor 15B are the same at the point in time when the left roll occurs, the controller 30 controls the output of the outboard motor 15B to be lower than the output of the outboard motor 15A.

It should be noted that it is possible to understand the roll suppression control when the right roll occurs by reversing the right and the left of the content of the roll suppression control when the left roll occurs.

Further, the effect, which is similar to the effect of the moment in the pitch-up direction applied to the port bow position and the moment in the pitch-up direction applied to the starboard bow position and is obtained by the change in the trim angle and the lift amount of the outboard motor 15A and the outboard motor 15B, acts as an adverse effect depending on the third control. However, since the effect explained in "the reason why the third control is effective" is more dominant, as a result, it is possible to obtain the roll suppression effect by the third control.

Figure 9:
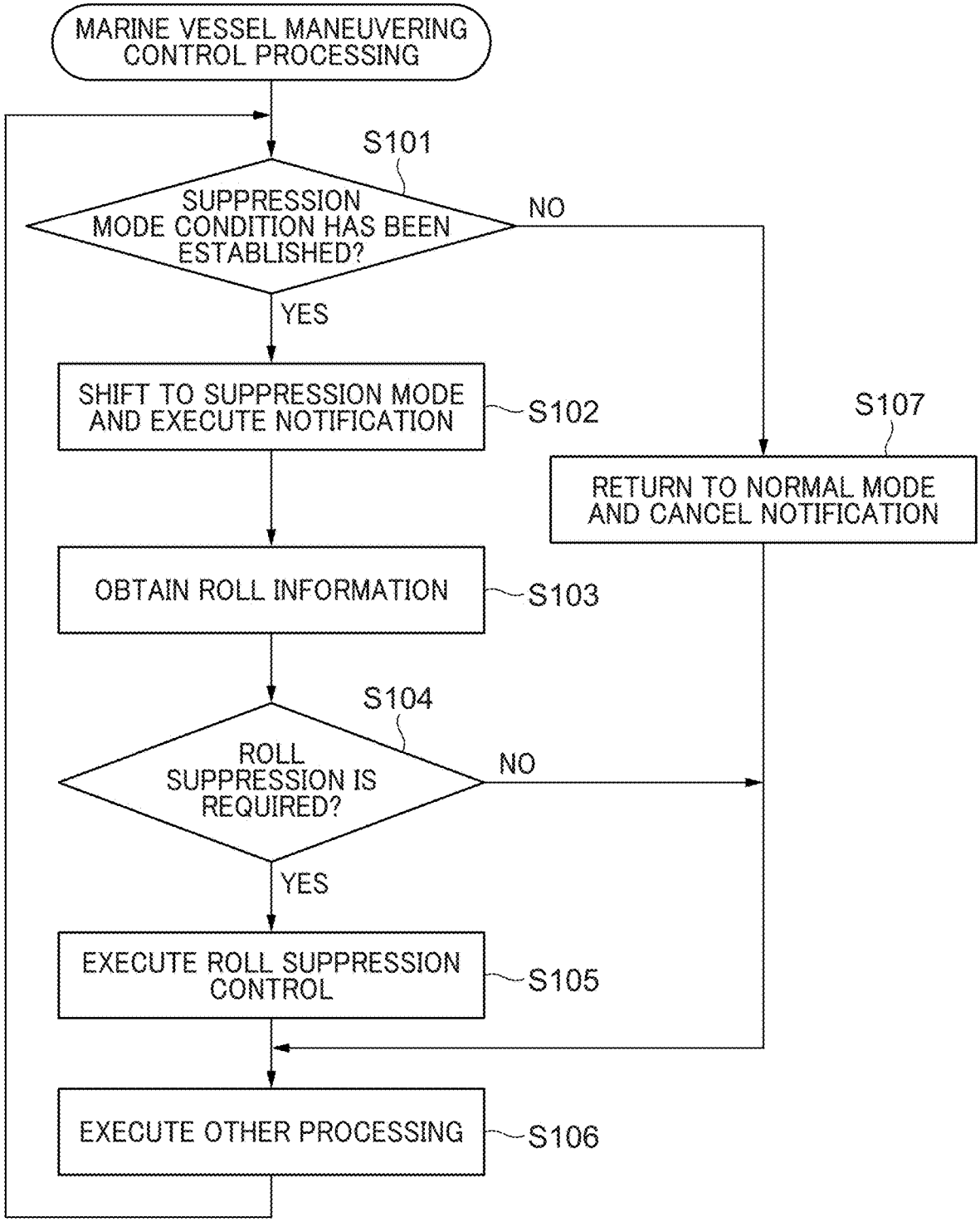
FIG. 9 is a flow chart that shows the flow of a marine vessel maneuvering control process.

FIG. 9 is a flow chart that shows the flow of a marine vessel maneuvering control process. The marine vessel maneuvering control process is realized by the CPU 31 loading the control program stored in the ROM 32 into the RAM 33 and executing it. The marine vessel maneuvering control process is started, for example, when the marine vessel maneuvering system is activated. In the marine vessel maneuvering control process, the CPU 31 defines and functions as the judging unit and the control unit in a preferred embodiment of the present invention.

As shown in FIG. 9, in step S101, the CPU 31 judges whether or not a suppression mode condition has been established. Here, the marine vessel maneuvering mode includes a normal mode and a suppression mode. The suppression mode is a mode that automatically suppresses the roll displacement. The normal mode is a mode, in which the roll displacement is not automatically suppressed. The suppression mode condition is established, for example, when the marine vessel speed exceeds a predetermined speed. Alternatively, the suppression mode condition may be established in the case that the marine vessel speed exceeds the predetermined speed and the traveling direction of the hull 13 is the straight traveling direction.

In the case that the CPU 31 judges that the suppression mode condition has been established, the marine vessel maneuvering control process proceeds to step S102. On the other hand, in the case that the CPU 31 judges that the suppression mode condition has not been established, the marine vessel maneuvering control process proceeds to step S107. In the step S102, in the case that the marine vessel maneuvering mode is the normal mode, the CPU 31 shifts the marine vessel maneuvering mode to the suppression mode, and executes a notification to notify that the marine vessel maneuvering mode is the suppression mode. On the other hand, in the step S107, in the case that the marine vessel maneuvering mode is not the normal mode, the CPU 31 returns the marine vessel maneuvering mode to the normal mode, and cancels the notification. Thereafter, the marine vessel maneuvering control process proceeds to step S106.

After the step S102, in step S103, the CPU 31 obtains the roll information based on the signals outputted from the attitude sensor 38. In step S104, the CPU 31 judges whether or not the roll suppression is required based on the obtained roll information. For example, the CPU 31 calculates a roll angle based on the roll information, and in the case that the calculated roll angle exceeds a predetermined angle, judges that the roll displacement of the hull 13 has occurred and that the roll suppression is required.

In the case that the CPU 31 judges in the step S104 that the roll suppression is not required, the marine vessel maneuvering control process proceeds to the step S106. On the other hand, in the case that the CPU 31 judges in the step S104 that the roll suppression is required, in step S105, the CPU 31 executes the roll suppression control. The roll suppression control is as described above, and at least one of the first control or the second control (further the third control) is executed.

In the step S106, the CPU 31 executes "other process", and the marine vessel maneuvering control process returns to the step S101. In "the other process" referred to here, for example, various kinds of processes corresponding to the settings and operations performed in the setting operation unit 19 are executed. For example, in the case that an instruction to end the marine vessel maneuvering system is received from the setting operation unit 19, in "the other process", a process to end the marine vessel maneuvering control process is executed.

According to a preferred embodiment of the present invention, in the case of being judged that the displacement in the roll direction of the hull 13 (the roll displacement of the hull 13) has occurred, since either one or both of the first control and the second control are executed, it is possible to suppress the displacement in the roll direction of the hull 13.

It should be noted that the marine vessel 11 may be provided with two or more sets of propulsion devices including the left propulsion device, which is located on the left of the center in the left-right direction, and the right propulsion device, which is located on the right of the center in the left-right direction, and that the number of sets of propulsion devices to be subjected to the roll suppression control may be one or more among the two or more sets of propulsion devices.

It should be noted that the propulsion device is not limited to a propulsion device including an engine as power, and may be a propulsion device using an electric motor.

It should be noted that as long as either one or both of the first control and the second control are able to be executed, the marine vessel may be a marine vessel or a jet boat that is equipped with inboard motors or inboard/outboard motors.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:

a hull;

left and right propulsion devices attached to a stern of the hull and located left of and right of, respectively, a center of the hull in a left-right direction;

left and right drive units to change a rotation angle of the left and right propulsion devices about left and right tilt shafts, respectively, and to set an angle, at which a position of a lower portion of the left and right propulsion devices becomes highest, as a maximum rotation angle;

left and right lift mechanisms to change a lift amount of the left and right propulsion devices, respectively, with respect to the hull; and a controller configured or programmed to function as:

a judging unit to judge whether or not a displacement in a roll direction of the hull has occurred; and a control unit to control the left and right drive units and the left and right lift mechanisms; wherein in a case that the judging unit judges that the displacement in the roll direction of the hull has occurred, the control unit executes either one or both of a first control to differentiate the rotation angle of the left propulsion device from the rotational angle of the right propulsion device using the left and right drive units, and a second control to differentiate the lift amount of the left propulsion device from the lift amount of the right propulsion device using the left and right lift mechanisms.

2. The marine vessel according to claim 1, wherein, in the first control, in a case that the displacement in the roll direction of the hull in a first direction among a left direction and a right direction has occurred, the control unit executes at least one of increasing the rotation angle of one of the left propulsion device or the right propulsion device that corresponds to a second direction opposite to the first direction, or decreasing the rotation angle of one of the left propulsion device or the right propulsion device that corresponds to the first direction.

3. The marine vessel according to claim 1, wherein, in the second control, in a case that the displacement in the roll direction of the hull in a first direction among a left direction and a right direction has occurred, the control unit executes at least one of lowering the lift amount of the left propulsion device or the right propulsion device that corresponds to a second direction opposite to the first direction, or raising the lift amount of the left propulsion device or the right propulsion device that corresponds to the first direction.

4. The marine vessel according to claim 1, wherein in the case that the judging unit judges that the displacement in the roll direction of the hull has occurred, the control unit further executes a third control; and in the third control, in a case that the displacement in the roll direction of the hull to a first direction among a left direction and a right direction has occurred, the control unit executes at least one of decreasing an output of the left propulsion device or the right propulsion device that corresponds to a second direction opposite to the first direction, or increasing an output of the left propulsion device or the right propulsion device that corresponds to the first direction.

5. The marine vessel according to claim 1, wherein, in a case that a detected roll angle exceeds a predetermined angle, the judging unit judges that the displacement in the roll direction of the hull has occurred.

6. The marine vessel according to claim 1, wherein, in the first control, in a case that the displacement in the roll direction of the hull to a first direction among a left direction and a right direction has occurred, the control unit makes the rotation angle of the left propulsion device or the right propulsion device that corresponds to a second direction opposite to the first direction larger than the rotation angle of the left propulsion device or the right propulsion device that corresponds to the first direction.

7. The marine vessel according to claim 1, wherein, in the second control, in a case that the displacement in the roll direction of the hull in a first direction among a left direction and a right direction has occurred, the control unit makes the lift amount of the left propulsion device or the right propulsion device that corresponds to a second direction opposite to the first direction lower than the lift amount of the left propulsion device or the right propulsion device that corresponds to the first direction.

8. The marine vessel according to claim 1, wherein in the case that the judging unit judges that the displacement in the roll direction of the hull has occurred, the control unit further executes a third control; and in the third control, in a case that the displacement in the roll direction of the hull to a first direction among a left direction and a right direction has occurred, the control unit makes an output of the left propulsion device or the right propulsion device that corresponds to a second direction opposite to the first direction lower than an output of the left propulsion device or the right propulsion device that corresponds to the first direction.

9. The marine vessel according to claim 4, wherein a propeller of the left propulsion device rotates counterclockwise when viewed from the rear, and a propeller of the right propulsion device rotates clockwise when viewed from the rear.

10. The marine vessel according to claim 8, wherein a propeller of the left propulsion device rotates counterclockwise when viewed from the rear, and a propeller of the right propulsion device rotates clockwise when viewed from the rear.

11. A control apparatus for a marine vessel including left and right propulsion devices attached to a stern of a hull and located left of and right of, respectively, a center of the hull in a left-right direction, left and right drive units to change a rotation angle of the left and right propulsion devices about left and right tilt shafts, and to set an angle, at which a position of a lower portion of the left and right propulsion devices becomes highest, as a maximum rotation angle, and left and right lift mechanisms to change a lift amount of the left and right propulsion devices, respectively, with respect to the hull, the control apparatus comprising:

a controller configured or programmed to function as:

a judging unit to judge whether or not a displacement in a roll direction of the hull has occurred; and a control unit to control the left and right drive units and the left and right lift mechanisms; wherein in a case that the judging unit judges that the displacement in the roll direction of the hull has occurred, the control unit executes either one or both of a first control to differentiate the rotation angle of the left propulsion device from the rotational angle of the right propulsion device using the left and right drive units, and a second control to differentiate the lift amount of the left propulsion device from the lift amount of the right propulsion device using the left and right lift mechanisms.

12. A marine vessel comprising:

a hull;

left and right propulsion devices attached to a stern of the hull and located left of and right of, respectively, a center of the hull in a left-right direction;

left and right drive units to change a rotation angle of the left and right propulsion devices about left and right tilt shafts, respectively, and to set an angle, at which a position of a lower portion of the left and right propulsion devices becomes highest, as a maximum rotation angle;

left and right lift mechanisms to change a vertical position of the left and right propulsion devices, respectively, with respect to the hull; and a controller configured or programmed to function as:

a judging unit to judge whether or not a displacement in a roll direction of the hull has occurred; and a control unit to control the left and right drive units and the left and right lift mechanisms; wherein in a case that a detected roll angle exceeds a predetermined angle, the judging unit judges that the displacement in the roll direction of the hull has occurred; and in a case that the judging unit judges that the displacement in the roll direction of the hull has occurred, the control unit executes either one or both of a first control to change the rotation angle of at least one of the left propulsion device with the left drive unit or the right propulsion device with the right drive unit, and a second control to change the vertical position of at least one of the left propulsion device with the left lift mechanism or the right propulsion device with the right lift mechanism.

* * * * *